United States Patent [19]

Salama et al.

[11] Patent Number: 4,619,557

[45] Date of Patent: Oct. 28, 1986

[54] CORROSION PROTECTION FOR MOORING AND RISER ELEMENTS OF A TENSION LEG PLATFORM

[75] Inventors: Mamdouh M. Salama, Ponca City, Okla.; Roderick J. Myers, Esher, United Kingdom; William H. Thomason; Michael H. Joosten, both of Ponca City, Okla.

[73] Assignee: Conoco Inc., Ponca City, Okla.

[21] Appl. No.: 606,023

[22] Filed: May 2, 1984

[51] Int. Cl.[4] ..... E02B 17/00; C23F 13/00

[52] U.S. Cl. ..... 405/211; 204/148; 204/197; 405/195; 427/34; 427/423

[58] Field of Search ..... 405/211, 195, 224; 52/515; 204/196, 197, 148; 427/423, 34

[56] References Cited

U.S. PATENT DOCUMENTS

| | | | |
|---|---|---|---|
| 3,019,118 | 1/1962 | Wallen | 204/148 X |
| 3,047,478 | 7/1962 | Marsh et al. | 204/148 |
| 3,137,642 | 6/1964 | Johns | 204/148 |
| 3,309,167 | 3/1967 | Galler | 405/211 X |
| 4,089,767 | 5/1978 | Sabins | 405/211 X |
| 4,226,555 | 10/1980 | Bourne et al. | 405/204 X |
| 4,240,829 | 12/1980 | Lukin et al. | 204/148 X |
| 4,349,581 | 9/1982 | Asano et al. | 427/34 |
| 4,415,293 | 11/1983 | Engel et al. | 405/211 X |
| 4,484,839 | 11/1984 | Nandlal et al. | 405/211 |
| 4,506,485 | 3/1985 | Apostolos | 52/515 |
| 4,529,616 | 7/1985 | Smythe | 427/423 X |
| 4,578,115 | 3/1986 | Harrington et al. | 427/423 X |

OTHER PUBLICATIONS

"Thermal Spray Coatings to Combat Corrosion in the Construction and Building Industry", by Brian Callaghan, Aug. 1979, pp. 5, 7, 8, 11 and 15.

"Metal Sprayed Coating Systems for Corrosion Protection Aboard Naval Ships", by Metric, Nov. 23, 1981, pp. ii, 1 and 17.

"Corrosion Protection of Offshore Structures", by Yoshiake Shimizu, Sakae Fujita, Akio Kida, Norio Syoji, Noboru Shima and Akihiro Tamada, pp. 72–82, Overseas No. 35 (1982).

Metallizing with Aluminum, by Gilbert C. Close.

*Primary Examiner*—Dennis L. Taylor

*Attorney, Agent, or Firm*—Stephen A. Littlefield

[57] ABSTRACT

A flame sprayed aluminum coating of high strength steel components offers excellent seawater corrosion protection, increased fatigue life and uniform low level cathodic protection that avoids hydrogen embrittlement. Marine mooring and riser elements fabricated from such components are superior in the above respects to steel components protected from corrosion by common sacrificial anode cathodic protection systems. In addition, the need of welding a stud to the steel to insure electrical continuity between the steel and the sacrificial anodes is eliminated.

3 Claims, 2 Drawing Figures

CORROSION PROTECTION FOR MOORING AND RISER ELEMENTS OF A TENSION LEG PLATFORM

This invention relates to the art of tension leg platforms for the recovery of subsea hydrocarbons and, more particularly, to a tensioned mooring and riser element which is more resistant to corrosive distruction without the need for heavy and complicated cathodic protection systems typically found in the art.

BACKGROUND OF THE INVENTION

Offshore structures are in constant need of protection from the corrosive environment of seawater. The useful life of offshore steel structures such as oil well drilling and production platforms and piping systems and particularly the tensioned, high strength steel mooring and riser elements of a tension leg platform system are severely limited by the corrosive environment of the sea. Conventional protection against such damage adds considerable complications and weight to offshore structures.

Cathodic protection by either sacrificial anodes or impressed current is generally effective in preventing corrosion on fully submerged portions of an offshore structure. In some offshore locations, such as the North Sea, oxygen content is relatively high even in water depths up to 1,000 feet. As a consequence, oxidative corrosion is very severe and can occur at these depths.

Installation and maintenance of sacrificial anodes adds greatly to the weight and expense of an offshore structure. This is particularly true with respect to a tension leg platform. In a tension leg platform, high strength, thick walled steel tubulars are constantly maintained in tension between their anchor points on the ocean floor and a floating structure whose buoyancy is constantly in excess of its operating weight. The use of high strength steel in the TLP for fabricating the mooring and riser systems is necessitated by the desire to reduce the TLP displacement and minimize the need for complicated tensioning and handling systems. The mooring and riser systems are subjected to more than 100,000,000 loading cycles during a common service life for a tension leg platform. This makes corrosion and corrosion fatigue resistance an important design parameter. Therefore, the selection of a corrosion protection system that achieves long term corrosion protection and minimizes the influence of the seawater environment on fatigue resistance is essential to insure the integrity of the high strength steel components.

The most common approach to corrosion protection involves the use of aluminum anodes. Such a system suffers the disadvantage that the cathodic potential on the steel with respect to such aluminum anodes approaches minus 1,050 mV verses a saturated calomel electrode (SCE). This cathodic level can result in hydrogen embrittlement in the high strength steel used in mooring elements. Testing has shown that a cathodic potential below negative 800 mV (SCE) subjects the high strength steel to hydrogen embrittlement thereby limiting the cracking resistance and fatigue life of the mooring and riser systems. Additionally, a reliable electrical contact must be maintained between a sacrificial anode and the high strength steel tubulars. The electrical attachment method must not impair the mechanical or the metalurgical performance of the steel. Mechanical electrical connections are generally not reliable and not recommended for long term use. Brazing and thermit welding can enhance the potential of stress corrosion cracking of high strength steels. Friction welding of an aluminum stud to the high strength steel has also been shown to cause failure in test specimens when cracks initiated either under the stud or at the edge of the weld.

An impressed current system for this application would involve throwing current from anodes located on the hull of the floating structure. The distance between anodes and remote components would be too great for effective control of the impressed current particularly at remote locations such as the anchor end of the mooring system.

For the protection of high strength steel components such as the mooring and riser systems for TLPs, the use of inert coatings cannot be seriously considered without the addition of cathodic protection because of the inevitable damage to and water permeation of the coatings through the life of the platform. Also, some areas of the components have tolerances that do not permit coating. With coatings, the size of the required sacrificial anodes would be greatly reduced but the electrical connection and hydrogen embrittlement problems would still be present.

SUMMARY OF THE INVENTION

The present invention provides for the cathodic protection of tensioned high strength steel mooring and riser elements with the use of an anodic metal coating which is directly bonded to the outer surface of the mooring elements. The coating provides excellent electrical contact between the anodic metal and the substrate to be protected, a uniform low level cathodic potential which avoids hydrogen embrittlement and, surprisingly, extended fatigue life for the coated elements when compared to other cathodic protection systems.

In accordance with the invention, substantially vertical, mooring and riser elements for a floating offshore structure comprises a high strength steel tubular member having a coating thereon of flame sprayed aluminum.

Further in accordance with the invention, the above-noted coating of flame spayed aluminum has a thickness of at least about 200 microns, a bond strength between the coating and the steel of at least about 1,000 psi (7 MPa) and provides a uniform potential of about minus 875 mV (SCE).

It is therefore an object of this invention to provide a cathodic protection system for high strength steel tension legs of a tension leg platform which is of low weight.

It is a further object of this invention to provide a cathodic protection system for high strength steel tension legs of a tension leg platform which has excellent electrical contact between the anodic material and the high strength steel basis metal.

It is yet another object of this invention to provide a cathodic protection system which limits the hydrogen embrittlement of high strength steel in the marine environment.

BRIEF DESCRIPTION OF THE DRAWINGS

These and other objects of the invention are accomplished through the manner and form of the present invention to be described in greater detail hereinafter in conjunction with the accompanying drawings forming a part of this specification and in which.

DETAILED DESCRIPTION OF THE PREFERRED EMBODIMENTS AND THE DRAWINGS

Figure 1:
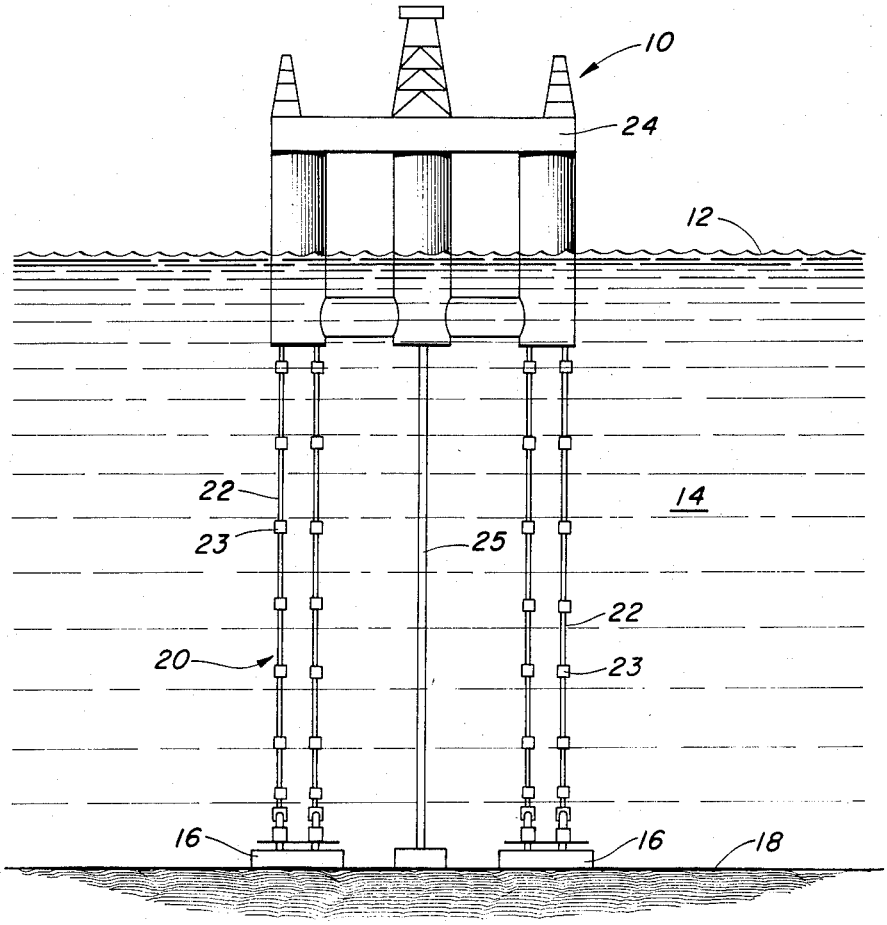
FIG. 1 depicts a tension leg platform in which the cathodically protected mooring elements of the present invention are utilized.

The present invention will now be described in greater detail through a description of a preferred embodiment thereof. It will be understood that such a description of a preferred emodiment is for the purposes of illustration only and should not be considered as a limitation upon the scope of the invention. Referring now to the drawing, FIG. 1 illustrates a typical tension leg platform 10 floating on the surface 12 of a body of water 14. A subsea anchoring means 16 is secured to the bottom 18 of the body of water 14 in any manner common in the art such as by pilings sunk into the sea bottom. A plurality of substantially vertical mooring elements 20 comprising a plurality of tubular joints 22 connected by collars 23 extends from the subsea anchoring means 16 to a floating structure 24 of the TLP 10. A substantially vertical production riser 25 extends from the floating structure to a well head located on the sea bottom 18. The floating structure 24 commonly is of the form of a large, semi-submersible drilling and production platform which has been modified for tension leg mooring.

The mooring elements 20 are maintained constantly in tension due to the fact that the floating structure 24 has a buoyancy which is at all times in excess of its operating weight. The mooring elements 20 thereby restrict vertical motions of heave, pitch and roll in the tension leg platform 10.

Figure 2:
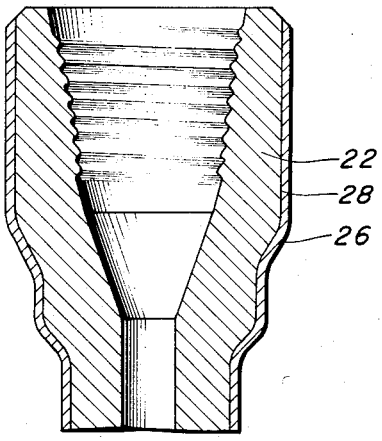
FIG. 2 is a cross-sectional, side elevational view of a portion of one of the mooring elements shown in FIG. 1 incorporating the anodic metal coating of the present invention.

As stated previosuly, the mooring elements 20 comprise a plurality of tubular joints 22 which, in accordance with the invention, are formed of high strength steel and have a coating 26 (FIG. 2) of flame sprayed aluminum. In accordance with the invention, the flame sprayed aluminum coating 26 is applied to the outer surface of the tubular joints 22 to a mean thickness of at least about 200 microns. In applying the coating 26, the surface 28 of the tubular joints are first prepared by grit blasting to provide an improved surface to which the flame sprayed aluminum coating 26 may easily bond. It can be seen that the bond between the flame sprayed aluminum coating 26 and the surface 28 of the tubular joints 22 provides excellent electrical contract between the anodic metal (aluminum) and the substrate to be protected (mooring elements 20). Riser elements 25 are similarly coated.

The following examples will illustrate the manner and form of the present invention and various advantageous results achieved by the use of the flame sprayed aluminum coating on the mooring elements of this invention.

EXAMPLE 1

Carbon steel samples were coated with flame sprayed uniform potential of about −875 mV (SCE). This potential provides maximum cathodic protection while avoiding excessive hydrogen embrittlement of the high strength steel substrate metal.

EXAMPLE 2

Cylindrial specimens of high strength 3½ Ni-Cr-Mo-V steel with a minimum yield strength of 795 $N/mm^2$ (115.3 ksi) were fatigue tested in seawater in a tension/-tension mode at 1/6th Hz at a means stress of about 400 $N/mm^2$. Corrosion protection was provided either by a flame sprayed aluminum coating in accordance with the invention or sacrificial aluminum anodes. An approximate 10 fold increase in the number of stress cycles to failure of the tested components was shown in the flame sprayed aluminum coated specimens when compared with those protected by sacrificial aluminum anodes. Thus, the fatigue life of a mooring element in accordance with the present invention is significantly greater than that found with the use of sacrificial anodes.

During the above fatigue tests, it was realized that high bond strength (above 7 MPa) is required to achieve the desired coating integrity. This level of bond strength was achieved through proper surface preparation and coating application. Thorough degreasing and grit blasting the surface of the high strength steel tubulars utilizing aluminum oxide to achieve a white metal finish with an anchor profile in the range of 75 to 115 microns are essential. Preheating to a surface temperature not less than 27° C. and spraying using 99.5 percent pure aluminum wire to achieve a nominal coating thickness of 200 microns using a multiple pass technique are required to achieve a uniform and homogenous coating. In order to fill the pores in the coating, a sealer coat utilizing zinc chromate primer and vinyl copolymer can be used. A silicone seal coating can also be used.

EXAMPLE 3

Unsealed and silicone sealed flame sprayed aluminum coated samples were exposed for nine months in a heated salt fog chamber (ASTM B117), which accelerated corrosion equivalent to 20 years ambient North Sea exposure. There were no signs of corrosion on the sample with the sealed coating. Minor corrosion damage occurred on the sample with the unsealed coating. For this reason, sealed coatings are preferred but not required, especially in the splash zone at the air, sea interface.

While the invention has been described in a more limited aspects of a preferred embodiment thereof, other embodiments have been suggested and still others will occur to those skilled in the art upon the reading and understanding of the foregoing specifciation. It is intended that all such embodiments be included within the scope of the invention as limited only by the depended claims.

Having thus described our invention, we claim:

1. In a tension leg platform for marine drilling and production of subsea hydrocarbons wherein substantially vertical high strength steel tubular elements are continuously submerged in sea water and constantly maintained in tension between subsea anchoring means and a floating platform by excess buoyancy of said platform, the improvement which comprises said tubular elements being cathodically protected by a coating elements, said coating of flame sprayed aluminum having a mean thickness of at least about 200 microns and an adhesive bond strength of about 7 MPa.

2. The improvement as set forth in claim 1 wherein said tubular elements comprise tubular mooring elements.

3. The improvement as set forth in claim 1 wherein said tubular elements comprise tubular riser members.

* * * * *